United States Patent [19]

Merrick

[11] Patent Number: 4,752,031

[45] Date of Patent: Jun. 21, 1988

[54] BUBBLER ASSEMBLY

[76] Inventor: Vincent A. Merrick, 10019 N. 56th St., Scottsdale, Ariz. 85253

[21] Appl. No.: 104,644

[22] Filed: Oct. 5, 1987

[51] Int. Cl.[4] ..... B05B 1/32; B05B 1/36

[52] U.S. Cl. ..... 239/193; 239/451; 239/542; 239/579; 239/581.2; 239/600; 251/175; 251/216; 251/351

[58] Field of Search ..... 239/460, 542, 590, 590.5, 239/650, 581.2, DIG. 1, 193, 31, 579, 457; 251/175, 216, 215, 351

[56] References Cited

U.S. PATENT DOCUMENTS

| | | | |
|---|---|---|---|
| 1,143,700 | 6/1915 | Hamill | 239/457 |
| 1,779,691 | 10/1930 | Bennett . | |
| 2,521,238 | 9/1950 | McCann | 239/542 |
| 2,574,812 | 11/1951 | Bradford | 239/457 |
| 2,650,132 | 8/1953 | Reinecke | 239/542 |
| 2,723,879 | 11/1955 | Martin | 239/542 X |
| 3,045,926 | 7/1962 | Steinen | 239/457 |
| 3,386,700 | 6/1968 | Greene et al. | 251/175 |
| 3,650,478 | 3/1972 | Jones | 239/DIG. 1 X |
| 4,131,234 | 12/1978 | Pescetto | 239/457 |
| 4,159,805 | 7/1979 | von Lutzow | 239/457 |
| 4,166,576 | 9/1979 | Harrison | 239/11 |
| 4,189,099 | 2/1980 | Bruninga | 239/DIG. 1 X |

*Primary Examiner*—Andres Kashnikow
*Assistant Examiner*—MaryBeth O. Jones
*Attorney, Agent, or Firm*—LaValle D. Ptak

[57] ABSTRACT

A bubbler includes two molded plastic parts, a main body portion with an internally threaded upper chamber terminating in a valve seat, and a hollow cap with a downwardly extending externally threaded valve stem for engagement with the internally threaded upper chamber of the body portion. Elongated channels extend from the open upper end of the body portion to a position adjacent the valve seat. When the cap is threaded onto the body portion with the end of the valve stem spaced from the valve seat, water flows from the lower chamber of the body portion past the valve seat and upwardly through the channels into the hollow part of the cap and then out through a space between the skirt on the cap and the body portion. When the cap is threaded downwardly to cause the valve stem to engage the valve seat, the bubbler is closed and no water flow takes place through it. Only two parts are required, and water flow adjustment is effected by rotation of the cap to regulate the flow from a full "off" flow to a maximum flow.

20 Claims, 1 Drawing Sheet

BUBBLER ASSEMBLY

BACKGROUND

Bubbler devices are widely used on automatic and semi-automatic watering systems for applying a metered uniform flow of water to the trees, shrubs, or garden beds in which they are installed. Typically, watering systems with which bubblers are employed incorporate a network of underground pipes, from which riser pipes extend at various positions where water is to be applied. The bubbler heads or bubbler devices are connected to the tops of these riser pipes. Typically the connection between the bubbler and the riser pipe is a threaded connection, so that the bubbler head may be removed or replaced when desired.

Typical bubblers are fabricated primarily of molded plastic parts and have relatively small passageways in them for controlling the flow of water under pressure in the riser pipe outwardly through the bubbler. These passageways frequently become plugged or clogged with particles of sand or other debris in the water supplied to the bubbler. To prevent clogging of the water passageways through bubblers, many bubblers employ an inverted cone-shaped filter screen at the bottom of the bubbler which extends into the riser pipe to trap or screen out particles of sand and other debris.

Although some bubblers are manufactured with no adjustment capability, the most widely accepted bubblers include a provision for adjusting the amount of water flow through the bubbler. This adjustment typically is from a full "off" position through an intermediate range to some maximum flow. The most popular forms of bubblers on the market today generally employ two or three plastic parts which are fitted together. In addition, a stainless steel adjustment screw interconnects the parts. This screw is adjusted either from inside the bubbler (which means the bubbler must be removed from the riser pipe to make the adjustment) or from a position through the top of the bubbler to effect the opening and closing of the passageways through the bubbler to control the water flow through it. Although the plastic parts are inexpensive, and the stainless steel adjustment screw also is inexpensive, the assembly requirements for interconnecting these parts comprise a substantial portion of the cost of the bubbler.

Efforts have been made to eliminate the stainless steel adjusting screw from bubbler devices. One such device is disclosed in the patent to Martin U.S. Pat. No. 2,723,879. This patent discloses a bubbler in the form of a three piece assembly. When the parts are interconnected together, water flow slots conduct the water from the riser pipe through the bubbler to distribution from beneath the cap of the bubbler. The cap of the Martin bubbler is internally threaded and fits over an externally threaded bottom portion. As a consequence, when the cap is screwed down to the closed position, water pressure within the cap tends to force it open; so that the parts need to be made relatively rigid to prevent leakage in the closed position of the bubbler.

Another attempt at simplification of a bubbler assembly by a reduction of parts is disclosed in the Patent to von Lutzow U.S. Pat. No. 4,159,805. This bubbler assembly is a two-piece plastic assembly. An extra manufacturing step, however, (or a more complicated mold) is necessary to provide radial passageways through the bubbler top to control the water flow. The nature of the radial passageways through the top of the von Lutzow device also limits the degree of adjustability of water flow which may be obtained from the bubbler. In addition, as with the device of the Martin patent, water pressure in the closed position tends to force the parts out of engagement with one another rather than into a tighter engagement; so that the parts must be made of relatively rigid material.

It is desirable to provide a simplified bubbler assembly, using a minimum number of parts, which is capable of simple and effective adjustment and which is not subject to the disadvantages of the prior art devices described above.

SUMMARY OF THE INVENTION

It is an object of this invention to provide an improved bubbler assembly.

It is another object of this invention to provide an improved molded plastic bubbler assembly.

It is an addition object of this invention to provide an improved two-piece molded plastic bubbler assembly.

It is a further object of this invention to provide an improved two-piece molded plastic bubbler assembly which is simple to manufacture, requires a minimum number of assembly steps and which is easily adjustable in use.

In accordance with a preferred embodiment of the invention, a bubbler device for supplying water at a controlled rate from a source of water includes two primary parts. These comprises a hollow body portion and a hollow cap portion. The body portion has a lower chamber for attachment to a source of water and a hollow open-ended, internally threaded, cylindrical, upper chamber with an inwardly extending annular valve seat interconnecting the lower and upper chambers. At least one elongated channel, which opens into the upper chamber, extends from a point adjacent the valve seat to the open upper end of the upper chamber. The cap portion is hollow and has a circular top with a downwardly turned skirt about the periphery of the top. The cap also has an internal, downwardly extending, central, cylindrical, externally threaded valve stem for engaging the interior of the upper chamber of the body portion. The valve stem has a lower end portion for engaging the valve seat to prevent water flow through the bubbler when the cap portion is turned downward into its lowermost position on the body portion of the device. The valve stem is hollow; so that water pressure within the lower chamber of the hollow body portion, when the valve stem engages the valve seat to close the device, causes the valve stem to be pressed into a tighter engagement with the valve seat. When the valve stem is turned upwardly out of engagement with the valve seat, water flows through the elongated channel into a hollow space between the upper end of the upper chamber of the body portion and the interior of the cap and then outwardly under the skirt.

DETAILED DESCRIPTION

Figure 1:
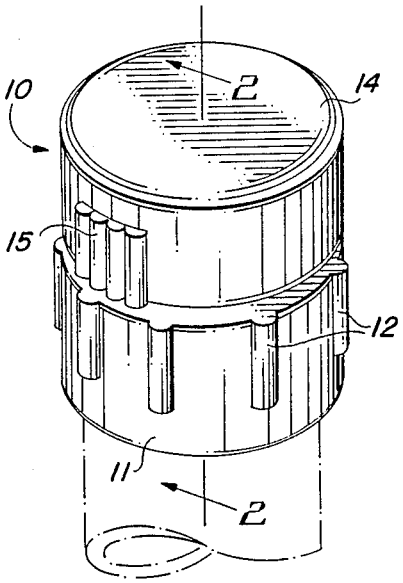
FIG. 1 is a perspective view of the exterior of a preferred embodiment of the invention.

Reference now should be made to the drawing in which the same reference numbers are used throughout the different figures to designate the same components. As illustrated in FIG. 1, a bubbler 10, in accordance with a preferred embodiment of the invention, includes a lower body portion 11 which has spaced ribs 12 formed about its outer circumference for facilitating installation of the base 11 on the top of a riser pipe (illustrated in dotted lines in FIG. 1). The bubbler 10 also includes a cap 14, which has a circular top and a downwardly extending skirt 40 which has an external diameter which is the same as the external diameter of the main body portion 11. Elongated ribs 15 are formed on opposite sides of the skirt 40 of the cap 14 to permit the cap to be easily grasped and rotated to adjust the water flow through the bubbler 10.

Figure 2:
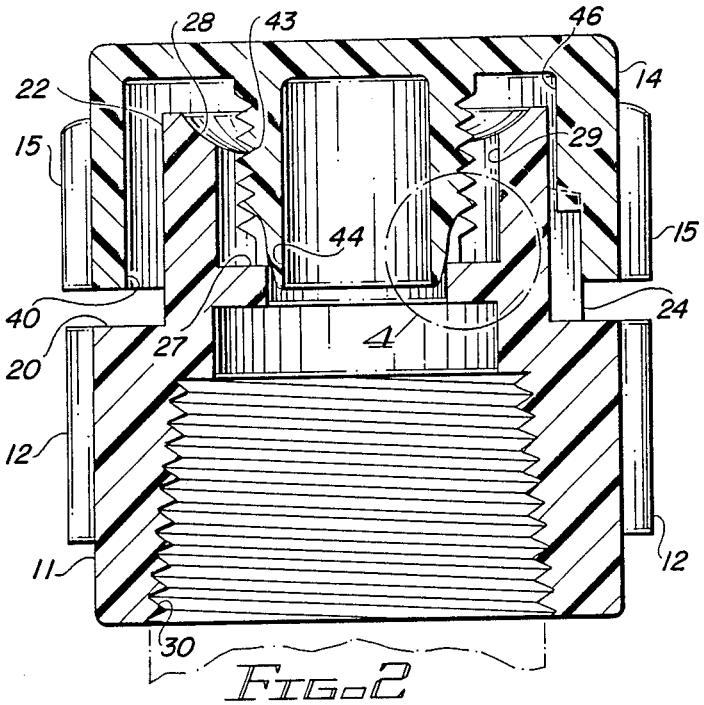
FIG. 2 is a cross-sectional view of the embodiment shown in FIG. 1.

FIG. 2 is a cross-sectional view of the bubbler of FIG. 1, taken along the line 2—2, and shows the features of construction in detail. The body portion 11 essentially consists of a lower chamber 30 and an upper chamber 22. The lower chamber 30 of the body portion 11 has internal threads to permit it to be screwed onto the end of a riser pipe in a conventional manner.

Figure 3:
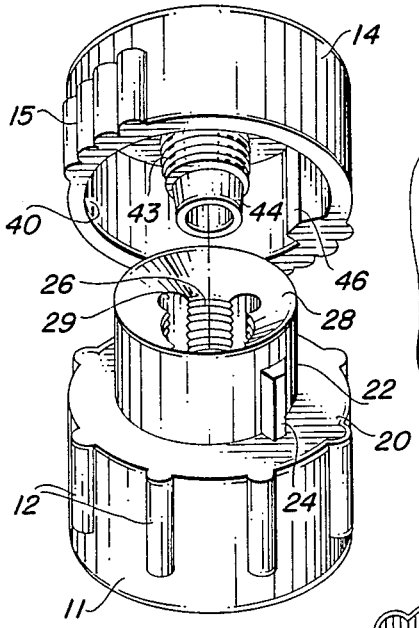
FIG. 3 is an exploded perspective view of the embodiment shown in FIG. 1.

The upper chamber 22 has an external diameter which is less than that of the lower chamber 30, and the two are connected together on the outside by a shoulder 20 (FIGS. 2 and 3). The upper chamber 22 is internally threaded with female threads 26 and extends downwardly to an annular valve seat 27 which separates the interiors of the two chambers from one another.

As illustrated most clearly in FIGS. 2 and 3, elongated semi-circular channels 29 are formed from the top of the upper chamber 22 downwardly to the valve seat 27 to provide water passageways through the upper chamber. These channels 29 interrupt or break the threaded portion 26 of the upper chamber 22, as is most readily apparent from an examination from FIGS. 3, 6 and 7. The top 28 of the upper chamber also is beveled or dish-shaped to facilitate water flow outwardly out of the channels 29 and uniformly over the outer edge of the upper chamber into the inside of the cap 14 when the bubbler is in use.

The second part of the bubbler comprises the cap 14 with the downwardly extending skirt 40 extending around its periphery. The central portion of the cap has a valve stem 43, 44 extending downwardly and axially aligned with the openings in the upper and lower chambers of the body portion 11. The upper part of the valve stem is an externally threaded portion 43 for engaging the threads 26 in the upper chamber 22 of the body portion 11. The lower end of the valve stem is a non-threaded portion 44, which is inwardly tapered and dimensioned to engage the edges of the annular valve seat 27 in the body portion 11.

The relative dimensions of the inside diameter of the skirt 40 and the length of the valve stem 43, 44 are selected to provide a space between the inside of the top of the cap 14 and the top of the upper chamber 22 of the body portion 11 and also to provide a space around the outside of the upper chamber 22 and the inside of the skirt 40 of the cap. This is shown most clearly in FIG. 2.

Figure 4:
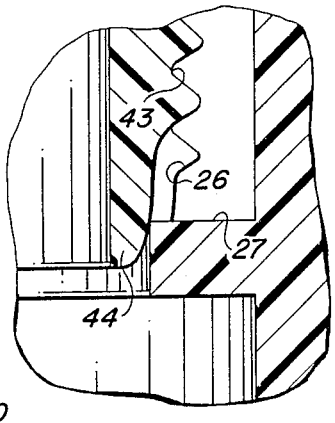
FIGS. 4 and 5 show details of the portion encircled in FIG. 2 for two different operating modes of the device.
Figure 5:
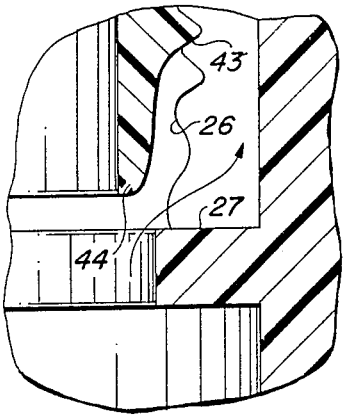

As illustrated in FIGS. 2 and 4, when the cap 14 is turned downward to its lowermost position, the end 44 of the valve stem tightly engages the annular valve seat 27 to close the bubbler and to prevent water flow through it. This is shown in enlarged detail in FIG. 4. This is accomplished by turning the cap downwardly (clockwise) through the actions of the mating threads 43 in the valve stem and 26 in the upper chamber 22 until the tapered end 44 of the valve stem engages the lip or edge of the annular valve seat 27. As is readily apparent from an examination of FIG. 2, the valve stem 43, 44 is hollow; so that water under pressure in the riser pipe and line to which the body portion 11 is attached, enters the inside of the valve stem and tends to expand the valve stem 43, 44 outwardly. This reinforces positive shutoff of the bubbler even under high water pressures. The greater the water pressure within the hollow valve stem, the more securely the tapered portion 44 is seated against the annular valve seat 27. By rotating the cap 14 in a counterclockwise direction, the tapered valve stem end 44 is raised upwardly out of engagement with the valve seat 27 to permit water flow to take place from the lower chamber 30 of the body portion 11, past the valve seat 27 and into the four vertical channels 29. Water flows upwardly out of these channels, past the beveled portion 28 and into the hollow space between the interior of the cap and the exterior of the upper chamber 22 of the body portion. From this space, the water then flows outwardly from the bubbler over the shoulder 20 under the bottom edge of the skirt 40. This path is most readily ascertained from an examination of FIGS. 2 and 5. The beveled edge 28 of the upper chamber 22 evenly distributes the water from the channels 29 throughout the interior of the cap 14, so that water flows outwardly over the shoulder 20 in a uniform manner.

Adjustment in the flow rate of the water through the bubbler is effected by the amount by which the valve stem 44 is raised above the inner edge or lip of the valve seat 27. A typical bubbler provides for a variation or adjustment of the water flow rate from zero to 2.5 gallons per minute, depending on the positioning of the valve stem 44 in the opening of the valve seat 27.

Another feature of the bubbler 10 which facilitates its assembly and its use comprises a pair of mating vertical bars 24 and 46. The bar 24 is on the outside of the upper chamber 22 of the body portion 11 and the bar 46 is on the inside of the skirt 40 of the cap 14. These are shown most clearly in the exploded view of FIG. 3. The bars 24 and 46 have flat vertical surfaces for engagement when the cap 14 is rotated counterclockwise with respect to the body portion 11, and have beveled or cammed surfaces on the opposite sides for engagement when the cap 14 is turned clockwise onto the body portion 11.

In assembling the cap 14 onto the body portion 11, the cap 14 is rotated clockwise to be screwed downwardly through the interaction of the threads 43 of the valve stem with the internal threads 26 on the inside of the upper chamber 22 of the body portion 11. The mating beveled surfaces on the bars 24 and 46 permit the cap 14 to continue rotation in this manner by camming the bar 46 outwardly and over the bar 24 during this downward rotation. This takes place until the valve stem portion 44 is seated tightly against the annular valve seat 27, as described previously.

Figure 6:
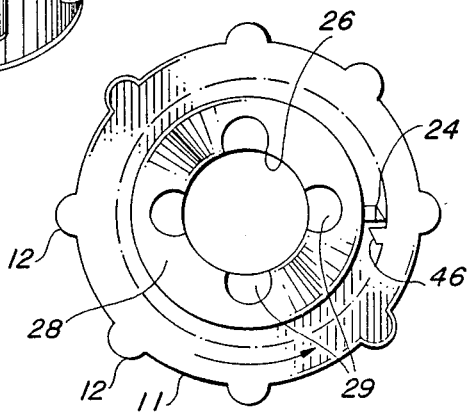
FIGS. 6 and 7 are top views diagrammatically illustrating a feature of operation of the embodiment of FIGS. 1 through 5.

When the bubbler is used, the valve stem end 44 is rotated upwardly out of engagement with the valve seat 27, as described previously. The adjustment from no flow to the maximum flow of the bubbler is effected within one 360° rotation of the two parts 11 and 14 with respect to one another. The limit of this rotation is obtained when the flat vertical surfaces of the bars 24 and 46 engage one another. This is illustrated diagrammatically in FIG. 6. FIG. 6 illustrates a top view of the body portion 11 showing the bar 24. A dotted line configuration of the internal diameter of the skirt 40 of the cap 14 showing the bar 46 also illustrates the two bars 24 and 46 at the point the flat surfaces engage. This establishes the maximum upward rotation of the cap 14 during normal use of the bubbler; and prevents removal of the cap 14.

Figure 7:
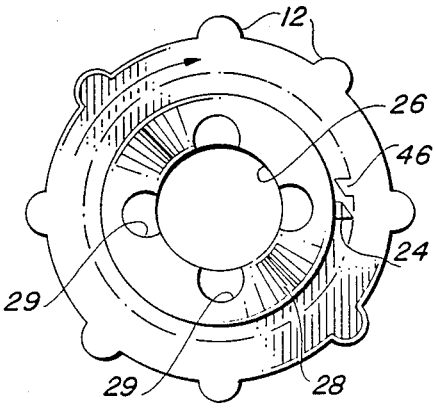

In a similar manner, FIG. 7 shows the relative positions of the bars 24 and 46 when the cap 14 is being rotated downwardly onto the body portion 11 to assemble the device. As illustrated in FIG. 7, the beveled or cammed surfaces of the bars 24 and 46 are about to engage the cam to the skirt 40 of the cap outwardly past the bar 24. Obviously, to permit this type of assembly, some flexibility of the cap 14, particularly of the skirt 40 is necessary. This is accomplished by a choice of the plastic which is used to fabricate the two parts of the bubbler assembly.

The assembly which is illustrated also permits relatively simple disassembly in the field to permit cleaning of the bubbler. To accomplish removal of the cap 14, the skirt 40 is squeezed together on opposite sides, at an equal distance between the ribs 15. This disorts the skirt 40 to an oval shape. When this is done and the cap 14 is simultaneously rotated in a counterclockwise direction, the bar 46 is moved out of engagement with the bar 24; so that the parts can pass by one another until the cap 14 is removed. After the cap 14 is removed, a large opening is present in the bubbler; and the application of water under pressure through this opening may be used to clear all debris, small stones and the like, which might otherwise become lodged in the channels 29. Consequently, no additional filter is necessary for use with this bubbler assembly. Because of the nature of the channels 29, however, the opening of the bubbler to its maximum flow position usually is sufficient to remove any debris or other particles which may otherwise become caught between the lower edge 44 of the valve stem and the valve seat 27. As a consequence, the bubbler assembly does not tend to clog; and if it should become clogged for any reason, it is a simple matter to clean it. It is not necessary to remove the bubbler from the riser pipe in order to effect cleaning in the manner described above.

The geometry of the channels 29 also may be selected to cause the width of the openings of these channels in the upper chamber 26 to be equal to or greater than the width of the threaded portion 26 between the channels 29. When this is done, it is possible to remove the mold core used to form the upper chamber 22 of the body portion by rotating the core 90° and then simply pulling it out of the body portion. This simplifies removal of the molded part from the tooling and is an additional advantage of the utilization of the four equally spaced channels 29 around the periphery of the upper chamber 22 of the body portion 11.

Various changes and modifications will occur to those skilled in the art without departing from the true scope of this invention. For example, the relative sizes of the various parts may be varied without changing in the manner of operation and of assembly of the device. A different valve stem/valve seat arrangement may be employed, and techniques may be used to limit the rotational positions of the cap relative to the base other than the bars 24 and 46 which have been described. The embodiment which is illustrated in the drawing, consequently, is to be considered to be illustrative only of the invention and not as limiting.

I claim:

1. A bubbler device for supplying water at a controlled rate from a source of water, said device including in combination:

a hollow body portion having a lower chamber for attachment to a source of water and a hollow, open-ended, internally threaded, cylindrical, upper chamber with an inwardly extending annular valve seat interconnecting said lower and upper chambers, and at least one elongated channel opening into the interior of said upper chamber and extending from a point adjacent said valve seat to the upper end of said upper chamber; and a hollow cap portion having a circular top and a downwardly turned skirt around the periphery of said top, said cap portion having a downwardly extending, central, cylindrical, externally threaded, valve stem member for engaging the internally threaded upper chamber of said body portion, said valve stem member having a lower end portion for engaging said annular valve seat to prevent water flow therethrough with said cap portion in its lowermost position on said body portion, and to permit water flow through said valve seat and through said elongated channel into a space between the upper end of said upper chamber and the interior of said cap portion with said cap portion in a position other than said lowermost position.

2. The combination according to claim 1 wherein said upper and lower chambers of said hollow body portion and said annular valve seat interconnecting said upper and lower chambers are comprised of a single molded plastic part.

3. The combination according to claim 2 wherein said hollow cap portion, including said top, said skirt and said valve stem member are made from a single molded plastic part.

4. The combination according to claim 3 wherein the lower end of said valve stem member is beveled for engagement with said valve seat.

5. The combination according to claim 4 wherein said valve stem member is hollow and open at the lower end thereof where said valve stem member engages said valve seat, so that water under pressure in the lower chamber of said body portion tends to force said valve stem member into tighter engagement with said valve seat when said valve stem member engages said valve seat in said lower most position of said cap portion.

6. The combination according to claim 5 wherein the wall thickness of said hollow valve stem member and the material out of which said valve stem member is made is caused to be slightly flexible.

7. The combination according to claim 6 further including means for inhibiting removal of said cap portion from said body portion following assembly of said cap portion onto said body portion.

8. The combination according to claim 7 wherein said inhibiting means comprises first and second elongated axially extending bars on the outside of said upper chamber of said hollow body portion and on the inside of said downwardly turned skirt on said cap portion, respectively, with said first and second bars having mating beveled edges to permit said cap portion to be threaded downwardly to the lowermost position thereof and having mating non-beveled edges to prevent turning of said cap portion in the opposite direction when said mating non-beveled edges of said bars are engaged.

9. The combination according to claim 8 wherein the outside of said lower chamber of said body portion is cylindrical in shape and has a predetermined diameter, and the outside of said upper chamber of said body portion is cylindrical in shape and has a predetermined diameter less than that of said lower chamber, the outside point of juncture of said upper and lower chambers comprising a flat annular shoulder on said body portion; and said downwardly turned skirt of said cap portion is spaced from said shoulder a predetermined distance.

10. The combination according to claim 9 further including a plurality of said elongated channels in said upper chamber of said body portion, each of said channels opening into the interior of said upper chamber and extending from a point adjacent said valve seat to the upper end of said upper chamber.

11. The combination according to claim 10 wherein the upper end of said upper chamber has a beveled edge to facilitate even water flow thereover into said cap portion.

12. The combination according to claim 1 further including means for inhibiting removal of said cap portion from said body portion following assembly of said cap portion onto said body portion.

13. The combination according to claim 12 further including a plurality of said elongated channels in said upper chamber of said body portion, each of said channels opening into the interior of said upper chamber and extending from a point adjacent said valve seat to the upper end of said upper chamber.

14. The combination according to claim 13 wherein the upper end of said upper chamber has a beveled edge to facilitate even water flow thereover into said cap portion.

15. The combination according to claim 1 wherein the lower end of said valve stem member is beveled for engagement with said valve seat.

16. The combination according to claim 15 wherein said valve stem member is hollow and open at the lower end thereof where said valve stem member engages said valve seat, so that water under pressure in the lower chamber of said body portion tends to force said valve stem member into tighter engagement with said valve seat when said valve stem member engages said valve seat in said lower most position of said cap portion.

17. The combination according to claim 16 wherein the wall thickness of said hollow valve stem member and the material out of which said valve stem member is made is caused to be slightly flexible.

18. The combination according to claim 1 wherein the outside of said lower chamber of said body portion is cylindrical in shape and has a predetermined diameter, and the outside of said upper chamber of said body portion is cylindrical in shape and has a predetermined diameter less than that of said lower chamber, the outside point of juncture of said upper and lower chambers comprising a flat annular shoulder on said body portion; and said downwardly turned skirt of said cap portion is spaced from said shoulder a predetermined distance.

19. The combination according to claim 1 further including a plurality of said elongated channels in said upper chamber of said body portion, each of said channels opening into the interior of said upper chamber and extending from a point adjacent said valve seat to the upper end of said upper chamber.

20. The combination according to claim 19 wherein the upper end of said upper chamber has a beveled edge to facilitate even water flow thereover into said cap portion.

* * * * *